US006508363B1

(12) United States Patent
Crevasse et al.

(10) Patent No.: US 6,508,363 B1
(45) Date of Patent: Jan. 21, 2003

(54) SLURRY CONTAINER

(75) Inventors: Annette M. Crevasse, Orlando, FL (US); William G. Easter, Orlando, FL (US); John A. Maze, III, Orlando, FL (US); Frank Miceli, Orlando, FL (US)

(73) Assignee: Lucent Technologies, Murray Hill, NJ (US)

( * ) Notice: Subject to any disclaimer, the term of this patent is extended or adjusted under 35 U.S.C. 154(b) by 0 days.

(21) Appl. No.: 09/541,792

(22) Filed: Mar. 31, 2000

(51) Int. Cl.[7] ..... B65D 81/02

(52) U.S. Cl. ..... 206/524.3; 206/524.5; 53/473; 220/62.21; 220/495.05

(58) Field of Search ..... 206/524.1, 527.3, 206/524.4, 524.5; 220/495.05, 495.06, 62.21, 495.04; 53/467, 473

(56) References Cited

U.S. PATENT DOCUMENTS 2,574,931 A * 11/1951 Nason, Jr. ..... 220/495.06
2,912,136 A * 11/1959 Redmond et al. ..... 220/495.06
3,321,070 A * 5/1967 Childs ..... 206/524.3
4,019,628 A * 4/1977 Derby ..... 206/524.4
4,318,475 A * 3/1982 Robinson ..... 206/524.3
4,820,653 A 4/1989 Easter et al.
4,839,309 A 6/1989 Easter et al.
4,870,029 A 9/1989 Easter et al.
4,987,471 A 1/1991 Easter et al.
H1137 H 2/1993 Easter et al.
5,183,152 A * 2/1993 Zak et al. ..... 206/524.4
H1174 H 4/1993 Easter et al.
5,366,924 A 11/1994 Easter et al.
5,478,758 A 12/1995 Easter
5,892,292 A 4/1999 Easter
5,911,619 A 6/1999 Uzoh et al.
5,951,382 A 9/1999 Crevasse et al.
5,967,885 A 10/1999 Crevasse et al.

* cited by examiner

*Primary Examiner*—Luan K. Bui

(57) ABSTRACT

A slurry container includes an outer surface and a cavity within the outer surface. Slurry is deposited in the cavity of the container and subsequently used for a variety of different purposes. Air pockets occurring within the cavity of the container are reduced in order to regulate particle size of the slurry.

10 Claims, 1 Drawing Sheet

SLURRY CONTAINER

FIELD OF THE INVENTION

The present invention relates generally to semiconductor devices and fabrication methods and more particularly to containers for storing and transporting slurry used in the fabrication process.

BACKGROUND OF THE INVENTION

Surface finishing is utilized in many arts for the polishing and/or planarization of particular devices. For simplicity, the term "polishing" will be used to include both polishing and/or planarization. One example of an application where polishing is performed and in multiple processing steps is in the manufacturing of semiconductor devices.

Chemical-mechanical planarization (CMP) is a technique widely used in the fabrication of semiconductor devices. CMP is performed by introducing a polishing fluid or slurry between a working surface and a polishing article, such as a wafer, and then moving the wafer and device relative to one another, most often by rotating. The slurry generally comprises abrasive particles which mechanically and chemically remove material. The chemical components of the slurry chemically alter the film being polished. The slurry along with the tool parameters planarize the surface of the semiconductor wafer. In the CMP process, it is important to control the particle size of the slurry. As an example, in the fabrication of semiconductor devices, in many applications the typical particle size is 50–200 nm. It is undesirable to have too large of a particle size since the larger particles can cause scratching to the polished surface. Too small of a particle size will have inadequate material removal rate. Scratching of the polished surface during manufacturing will lead to decreased device yields.

One source for larger particle size in a slurry mixture that has been noted by the inventors of the present application is the container which holds the slurry used in the manufacturing process. The containers often called totes or drums are commercially available in a number of different sizes, common types are in 55 gallon or 250 gallon sizes. The containers are filled with the slurry at their origination locations, by the slurry manufacturer and then transported to other sites for use, such as to the integrated circuit manufacturer. A problem identified in this process is that a portion of the slurry can dry inside of the container, such as along the container walls, due to movement of the slurry into air pockets inside of the container. The dried slurry can then mix with the liquid slurry mixture, such as by flaking off from the side walls, which results with larger sized particles contained in the slurry mixture. Some slurries have been shown to dry in less than five minutes exposure to air. There have been attempts made to correct this problem by minimizing transfer time and container agitation. In these situations, the desire is to limit the transport time before the slurry can begin to dry and to limit agitation so that the slurry liquid mixture will not splash or otherwise flow up along the side walls. These attempts have not produced satisfactory results. Also, filtering is used to eliminate the larger particles as the slurry is sent to the distribution system. Filters, however, are not one hundred percent effective.

There is a need for a new slurry transport container which eliminates or at least minimizes the air space or pockets inside of the container.

SUMMARY OF THE INVENTION

The present invention provides a container adapted for receiving slurry and which includes means for reducing air space inside of the container.

DETAILED DESCRIPTION OF THE INVENTION

Figure 1:
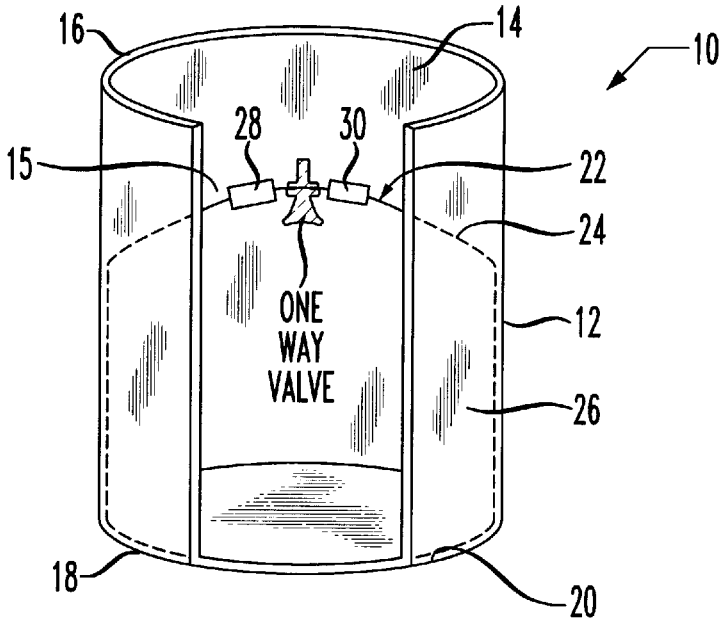
FIG. 1 is a cross-sectional side elevational view of a slurry container in accordance with an embodiment of the present invention.

Referring now to the drawings in detail, wherein like reference numerals indicate like elements throughout the several views, there is illustrated in FIG. 1 a cross-sectional side elevational view of a slurry container 10 in accordance with an embodiment of the present invention. As illustrated in FIG. 1, the slurry container 10 preferably comprises a tote or drum including an outer surface 12 and an opening 14 through the outer surface 12 and terminating by a cavity 15. In the illustrated embodiment, the container 10 is generally elongate in a longitudinal direction and the outer surface 12 defines upper and lower surfaces 16 and 18, respectively, at spaced separation, and with the opening 14 provided in the upper surface 16 and with the cavity 15 extending in a direction of the lower surface 18 and terminating by an inner surface 20. As should be understood, other configurations for the container 10 can also be utilized for the same purpose, which will be described in detail below.

As discussed earlier, a drawback of prior art slurry containers is that air pockets are present inside of the container, such as can occur between the inside wall defined by the cavity 15 and the slurry. One particular location where air pockets/space can occur is between the upper surface of the container, such as the underside of a lid, and the slurry which is filled to a particular level inside of the container. The air pockets/space can occur when the containers are initially deposited with slurry, during transport as the containers are jostled about as well as when the slurry is later used, such as in the manufacture of semiconductor devices. In view of this background, the slurry container 10 in accordance with the present embodiment includes means for reducing the amount of air pockets/space in the container. In a preferred embodiment the amount of air space/pockets is substantially reduced and in a more preferred embodiment the amount of air space/pockets is eliminated. One type of apparatus for this purpose is illustrated in FIG. 1, although it should be understood that other types of devices, although not shown, can also be provided for the same purpose.

The slurry container 10 in accordance with the present embodiment comprises a housing 22 provided in the cavity 15. The housing 22 defines an outer wall 24 and a bore 26 into which the slurry is received. In a preferred embodiment, the outer wall 24 of the housing 22 is substantially flexible. In a more preferred embodiment, the housing 22 comprises a bag comprised of plastic or of any other thermosetting or thermoplastic material, such as polyethylene. The housing 22 in accordance with the present embodiment also preferably includes means for adding and/or removing slurry from the bore 26. For this purpose, one embodiment comprises a re-sealable opening 28 through the outer wall 24, such as a removable plug or cap; for example, a threaded male/female engagement. Although not shown, another embodiment is to provide a conventional one-way valve through an opening in the outer wall 24, so as to allow slurry to be pumped into the bag but preventing slurry from passing back through the valve and out of the bore 26. An additional opening and delivery line(not shown) can also be provided attached to the outer wall 24 in order to remove the slurry for use. In addition, the housing 22 can be provided with a second opening 30 through the outer wall 24 and into the bore 26 for removing excess air in the bore 26 and also means for sealing of the second opening 30. For this purpose, any suitable device can be used, such as a removable cap or plug or a one-way valve discussed above. Notwithstanding the foregoing description, as should be understood, any suitable apparatus or device known in the art can be utilized in order to allow for the adding and/or removal of slurry and the removal of excess air inside of the bore of the housing 22. Although not shown, the slurry container 10 can also include a lid or similar device for closing of the opening 14 in the upper surface 16. The slurry container 10 can be made from any suitable material and from any of a number of different manufacturing processes; for example, the slurry container shall be comprised of formed metal, such as aluminum, or of injected molded plastic.

Figure 2:
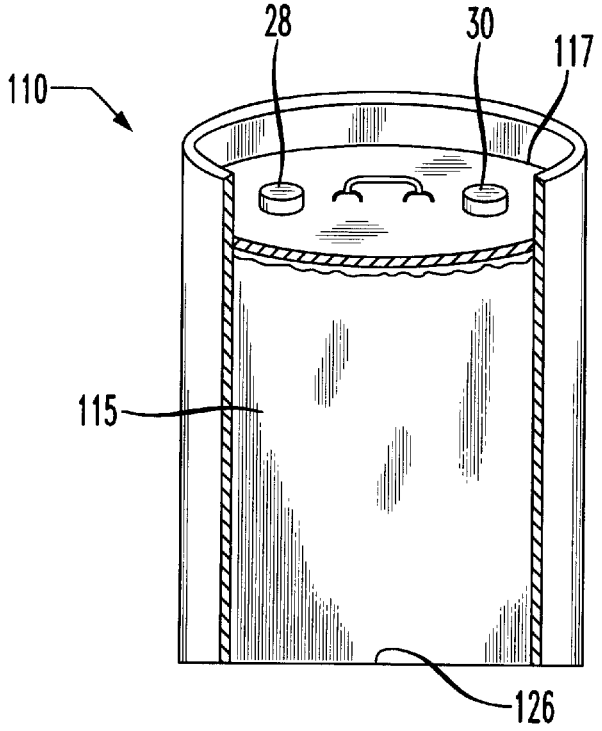
FIG. 2 is a cross-sectional side elevational of a slurry container in accordance with another embodiment of the present invention.

In FIG. 2 is illustrated a cross-sectional side elevational view of a slurry container in accordance with another embodiment of the present invention. The slurry container 110 illustrated in FIG. 2 in many aspects is similar to the slurry container 10 illustrated in FIG. 1. For reason of brevity, only the portions of the slurry container 110 which differ from the slurry container 10 will be described in detail herein. As illustrated in FIG. 2, slurry is adapted to be received directly in the cavity 115 of container 110. The container 110 also includes an adjustable lid 117. As discussed above with respect to the slurry container 10, the adjustable lid 117 is adapted to reduce the amount of air space in the container 110. In a preferred embodiment, the lid 117 is adapted to substantially reduce the amount of air space and more preferably to eliminate excess air space. A variety of different structural arrangements can be utilized for this purpose. In one embodiment, the cavity wall can be provided with a series of threads into which the perimeter of the lid 117 is received. The position of the lid 117 would then be adjusted by clockwise or counterclockwise rotation in order to move the lower surface 119 of the lid closer to the slurry mixture. As should be understood, any other suitable mechanism for adjusting the position of the lid 117 relative to the slurry mixture can also be utilized for the same purpose; for example, a frictional engagement between the perimeter of lid 117 and the cavity wall to accommodate longitudinal sliding motion of lid 117. In addition, the container 110 can also include an opening to allow for removal of excess air from the cavity of the container, as the position of the lid is adjusted longitudinally in a direction of the inner surface 126 of the container 110. Similar to that discussed above with respect to the slurry container 10, any suitable means can be provided for sealing of the opening or restricting passage of the slurry mixture out from inside of the container 110.

It will be recognized by those skilled in the art that changes may be made by the above-described embodiments of the invention without departing from the broad inventive concepts thereof. It is understood, therefore, that this invention is not limited to the particular embodiments disclosed, but it is intended to cover all modifications which are within the scope and spirit of the invention as defined by the appended claims.

What is claimed is:

1. A slurry transport drum comprising:

a rigid container forming a cavity of a fixed volume;

a flexible liner configured to receive a defined amount of slurry, wherein the flexible liner moves independently from the rigid container; and an opening through the flexible liner for at least one of adding or removing the defined amount of slurry and a removable seal for closing the opening, wherein the seal includes a one-way valve so as to allow slurry to be added to the flexible liner.

2. A slurry transport drum of claim 1, wherein the flexible liner further comprises a second opening through the substantially flexible outer wall for removing excess air in the flexible lines and a seal for closing the second opening.

3. A slurry transport drum of claim 2, wherein the flexible lines comprises a bag.

4. A container adapted for receiving slurry comprising:

a rigid container comprising a cavity;

a housing located within the cavity and defined by a substantially flexible outer wall, the housing having an upper surface free to move relative to the container and having a volume less than the cavity, wherein the housing has an opening therein adapted to receive a defined amount of slurry; and a removable seal for closing the opening, wherein the seal includes a one-way valve so as to allow slurry to be added to the housing.

5. A container of claim 4, wherein the housing further comprises a second opening through the substantially flexible outer wall and adapted for removing excess air in the housing and a seal for closing the second opening.

6. A container of claim 5, wherein the housing comprises a bag.

7. A method of transporting slurry, comprising:

providing a slurry transport drum, including;

a rigid container having a cavity;

a flexible liner located within the cavity and configured to receive a defined amount of slurry, wherein the flexible liner moves independently from the rigid container;

an opening through the flexible liner for at least one of adding or removing the defined amount of slurry; and a removable seal for closing the opening, wherein the seal includes a one-way valve so as to allow slurry to be added to the flexible liner;

placing a defined amount of slurry within said slurry transport drum, wherein said flexible liner prevents a substantial amount of air from contacting said slurry; and transporting said drum containing said defined amount of slurry from one location to another location.

8. The method recited in claim 7 further including removing at least a portion of said defined amount of slurry from said drum after transporting said drum.

9. The method recited in claim 8 wherein said removing includes removing at least a portion of said defined amount of slurry using a second opening in said flexible liner.

10. The method recited in claim 9 wherein said second opening prevents a substantial amount of air from contacting any remaining slurry.

* * * * *